US007166790B2

(12) United States Patent
May

(10) Patent No.: US 7,166,790 B2
(45) Date of Patent: Jan. 23, 2007

(54) PERCUSSION INSTRUMENT CARRIER ASSEMBLY

(76) Inventor: Randall L May, 2 Trafalgar, Newport Beach, CA (US) 92660

( * ) Notice: Subject to any disclaimer, the term of this patent is extended or adjusted under 35 U.S.C. 154(b) by 206 days.

(21) Appl. No.: 10/983,434

(22) Filed: Nov. 6, 2004

(65) Prior Publication Data

US 2006/0096443 A1 May 11, 2006

(51) Int. Cl.
*G10D 13/02* (2006.01)

(52) U.S. Cl. ..... 84/421; 84/327; 248/443

(58) Field of Classification Search ..... 84/421, 84/327; 248/443
See application file for complete search history.

(56) References Cited

U.S. PATENT DOCUMENTS 3,974,732 A * 8/1976 Kester, Jr. ..... 84/421
4,256,007 A 3/1981 Streit
4,387,839 A 6/1983 Dranchak
4,402,441 A 9/1983 Jones et al.
4,453,442 A 6/1984 LaFlame
4,453,446 A 6/1984 Hoshino
4,605,144 A * 8/1986 LaFlame ..... 224/265
4,634,032 A 1/1987 LaFlame
4,796,508 A * 1/1989 Hoshino ..... 84/421
4,799,610 A 1/1989 Hsieh
D354,975 S * 1/1995 Penn ..... D17/22
5,400,683 A * 3/1995 LaFlame ..... 84/421
5,520,292 A * 5/1996 Lombardi ..... 211/85.6
5,573,158 A * 11/1996 Penn ..... 224/265
5,586,705 A * 12/1996 Leonard ..... 224/631
5,725,139 A * 3/1998 Smith ..... 224/637
5,804,747 A * 9/1998 Chen ..... 84/327
5,973,247 A 10/1999 Matthews
5,984,157 A * 11/1999 Swetish ..... 224/631
6,028,257 A * 2/2000 May ..... 84/421
6,172,290 B1 * 1/2001 May ..... 84/421
6,323,407 B1 * 11/2001 May ..... 84/421
6,329,583 B1 * 12/2001 May ..... 84/421
6,765,140 B1 * 7/2004 Crouch ..... 84/421
6,881,886 B1 * 4/2005 May ..... 84/421
7,071,401 B1 * 7/2006 May ..... 84/421
2001/0047716 A1 * 12/2001 May ..... 84/421
2003/0005810 A1 * 1/2003 May ..... 84/421
2003/0192423 A1 * 10/2003 Crouch ..... 84/421
2003/0217636 A1 * 11/2003 May ..... 84/421
2004/0159211 A1 * 8/2004 Crouch ..... 84/421
2004/0194608 A1 * 10/2004 May ..... 84/421

(Continued)

OTHER PUBLICATIONS

U.S. Appl. No. 10/374,676, filed Nov. 2003, May.

(Continued)

*Primary Examiner*—Lincoln Donovan
*Assistant Examiner*—Robert W. Horn
(74) *Attorney, Agent, or Firm*—Buhler & Associates; Kirk A. Buhler

(57) ABSTRACT

Drum hardware and drum secured thereon are preferably supported on a vest type, T-bar or tubular carrier having a plurality of separate parts removable from each other and formed of a rigid plastic, light metal such as magnesium, aluminum or titanium. The removable hardware includes a removable back support member. The instrument carrier includes an articulating hinge that allows for positive, negative or neutral horizontal positioning of the instruments. The articulating hinge assembly further allows the carrier to be folded for easier transportation and storage in a smaller area.

24 Claims, 8 Drawing Sheets

U.S. PATENT DOCUMENTS

| | | | | |
|---|---|---|---|---|
| 2005/0183565 | A1* | 8/2005 | May | 84/421 |
| 2006/0081115 | A1* | 4/2006 | Shimada | 84/421 |
| 2006/0096443 | A1* | 5/2006 | May | 84/421 |
| 2006/0137506 | A1* | 6/2006 | May | 84/327 |
| 2006/0186151 | A1* | 8/2006 | May | 224/265 |

OTHER PUBLICATIONS

U.S. Appl. No. 10/170,005, filed Jan. 2003, May.

U.S. Appl. No. 09/756,479, filed Dec. 2001, May.

* cited by examiner

PERCUSSION INSTRUMENT CARRIER ASSEMBLY

FIELD OF THE INVENTION

This invention relates to new and useful improvements in apparatus for carrying percussion instruments, particularly drums of various kinds, cymbals, xylophones, and the like. More particularly, the present invention relates to a carrier hardware providing a novel articulating and adjustable hinge assembly for the support for percussion instruments and to carrier assemblies supporting percussion instruments on a person while standing, walking or marching. The carrier assembly has a construction and relationship of parts to transfer the weight of the percussion instrument(s) to the body of a person. The articulating hinge assembly allows positive, negative or neutral horizontal positioning of the instruments. The articulating hinge assembly further allows the carrier to be folded for easier transportation and storage in a smaller area. The person carrying the instruments maintains a stable attitude while walking or marching about and avoids pressure or other forms of detrimental forces on the shoulders and lower back and is further characterized by having removable and/or adjustable back support member or members. The front portion of the carrier is constructed with an upper and lower portions the separate construction of the two portions allows a shoulder strap toe-in and toe-out adjustment to the shoulder supports. The adjustment to the back support member position may also be accomplished using a fixed back support member with adjustable shoulder straps. The back member may be secured to the shoulder straps and the shoulder straps may be removable and or adjustable to accommodate different sized users.

BACKGROUND OF THE INVENTION

The prior art discloses many examples of apparatus for supporting percussion instruments but none providing the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back pressure plate, and wrap about shoulders and support straps connect to the abdominal plate, which has suitable fixtures for attachment of various percussion instruments. This invention uses a fixed chest plate that does not hinge or articulate, to allow for horizontal positioning of the instruments, or is capable of being folded for easier storage.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person. The patent includes a rigid band with a generally bent contour to extend along a portion of the waistline area of the person to the back of the person. The patent includes a back-plate riser arm supported by the ban to extend in a generally upward direction such that a portion of the arm will extend along the back thoracic region of the person, and means carried by the arm for imparting to the thoracic back region of the person. The arm causes a reactive force to the overhung weight of the instrument about the aforesaid means forming a fulcrum area of contact with the person. This patent uses a fixed chest support that does not articulate, to allow for horizontal positioning of the instruments. The patent also does not allow for folding the carrier for easier storage.

May U.S. Pat. No. 5,691,492 discloses hardware for supporting drums that is of a hinged construction and has one part of the hinge connectable to an external support, e.g., J-rods on a fixed support or a marching drum carrier. Another part of the hinge is connectable to the shell of a drum or to the tension rods on a drum or to other hardware on the drum. This invention allows for a hinge where the instruments are connected to the supporting structure, but the hinge is not located in the chest area of the user. The invention does not allow for horizontal positioning of the instruments. The invention is not capable of being folded for easier storage.

May U.S. Pat. No. 6,323,407 discloses hardware for a shoulder-supported carrier for percussion instruments with a hinge located in the chest area. This invention allows for a hinge in the chest support region, but it does not, allow for horizontal positioning of the instruments.

May U.S. Pat. No. 6,028,257 shows drum hardware and drums secured thereon preferably supported on a vest type carrier or a T-bar carrier or a fixed post or pedestal.

May U.S. Pat. No. 6,172,290 shows a hinged support for an array of drums.

May U.S. Pat. No. 6,329,583 discloses hardware and drums secured thereon preferably supported on a vest type carrier or a T-bar carrier with adjustable vest components.

May U.S. Pat. No. 6,403,869 discloses hardware and drums secured thereon preferably supported on a vest type carrier or a T-bar carrier with adjustable vest components.

The prior art discloses many examples of apparatus for supporting percussion instruments but none provide the combination of features that allow for an articulating assembly that allows for positive, negative or neutral horizontal positioning of the instruments. The prior art does not disclose an assembly that can be folded to allow for easier transportation and storage. The combination of features will be disclosed and claimed herein.

BRIEF SUMMARY OF THE INVENTION

One of the objects of this invention is to provide a new and improved instrument carrier that provides positive, negative or neutral horizontal positioning to account for the contour of the user's body and indirect positioning of the musical instrument.

Another object of the invention is providing an articulating hinge mechanism that can be adjusted from free movement to a locked orientation, including frictional settings between the two extreme settings.

Another object of the invention is to provide an instrument carrier that can be folded to allow for easier transportation, carrying and storage.

Another object of the invention is to provide changeable padding on the back support to allow for a variety of cushioning heights.

One object of the invention is to provide a new and improved carrier for percussion instruments, e.g., a snare drum, having hardware with a removable back bar, back plate, back member, back members, back support member or back pressure plate.

Another object of the invention is to provide a new and improved carrier for percussion instruments comprising a back support member with adjustable width Another object of the invention is to provide adjustment to the back support member where the back support member is attached to adjustable shoulder straps wherein adjustment to the shoulder straps, moves the back support member.

Another object of the invention is to provide shoulder width adjustment to account for users of various sizes. The adjustment consists of a toe-in and toe-out adjustment for width.

Another object of the invention is to provide an adjustable frictional pivoting mechanism to link the shoulder straps with the back member.

Another object of the invention is to provide a new and improved carrier for percussion instruments comprising a novel supporting vest of composite material (Fiberglas), rigid removable shoulder straps of light metal, and back member of light metal such as aluminum, magnesium, etc.

Another object of the invention is to provide a back member that is secured to shoulder straps that are removable and or adjustable to accommodate different sized users. The securing method may be rigidly secured or secured with fasteners that allow the back member to pivot on the shoulder straps. The secured back member may be adjustable for width.

Various objects, features, aspects, and advantages of the present invention will become more apparent from the following detailed description of preferred embodiments of the invention, along with the accompanying drawings in which like numerals represent like components.

DETAILED DESCRIPTION OF THE INVENTION

Figure 1:
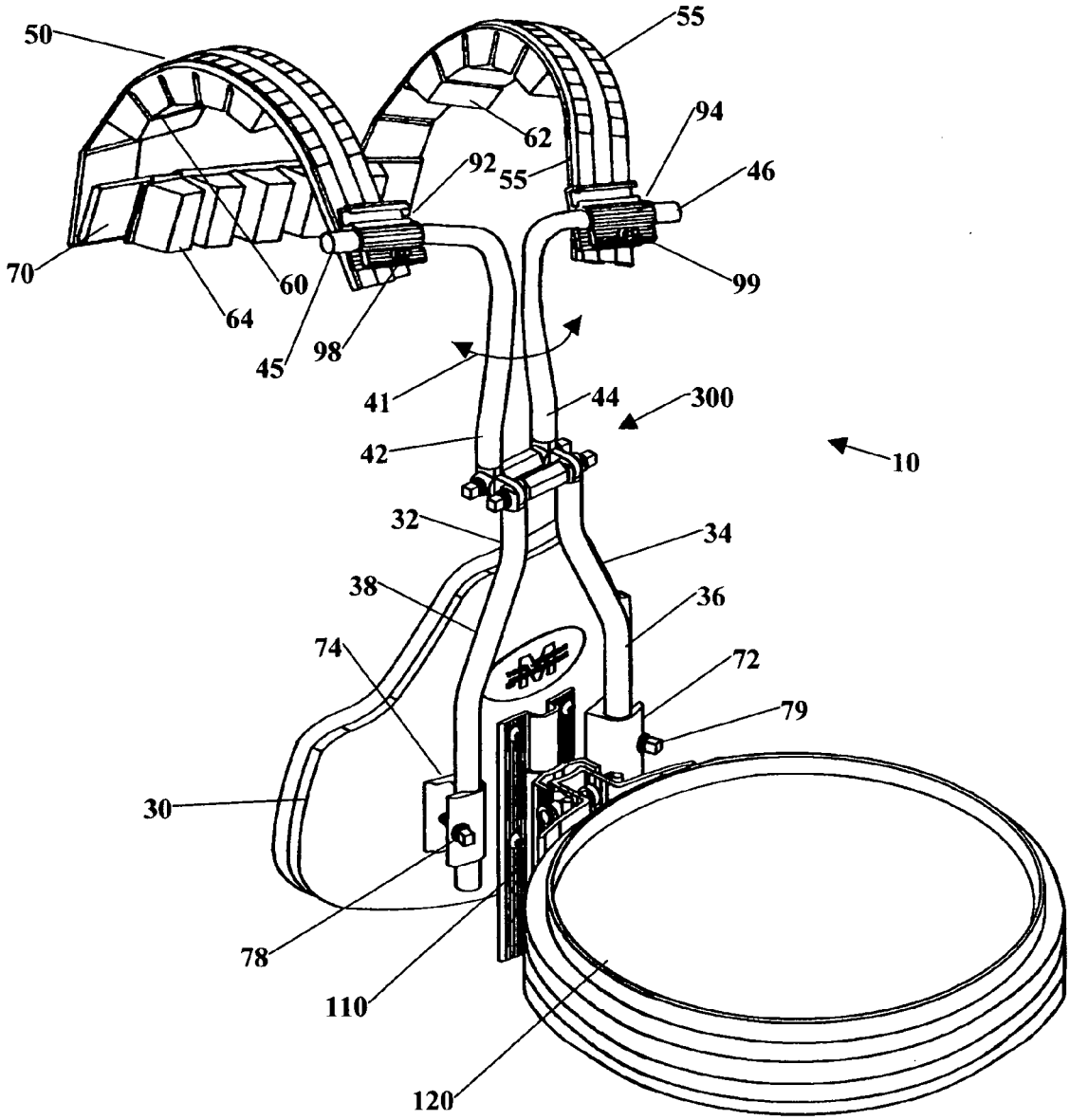
FIG. 1 is an isometric view if a tubular construction vest for a marching drum assembly with an articulating hinge assembly with toe-in and toe-out adjustment.

Referring to FIG. 1, there is shown a Tubular type carrier 10 for percussion instruments that comprises a belly plate 30, with lower support rods 32 and 34. The figure also has upper body vertical support rods or tubes 42 and 44. The upper and lower body support rods or tubes are connected to each other with a compound hinge mechanism 300. The lower rods or tubes 32 and 34 are bent to allow the tubes to connect to the compound hinge in a narrow position, independently spread to parallel portions 36 and 38 where they attach to supporting belly plate 30. Upper rods or tubes 42 and 44 having out-turned portions 45 and 46 supporting rigid shoulder straps 50 and 55 and back bar 70. Back bar 70 may be removably secured to shoulder straps 50 and 55 or may be fixed as by welding or the like. Shoulder straps 50, 55, and back bar 70 have cushions 60, 62 and 64, respectively. The cushions are of a type used to pad the interior of football and other sports helmets and are shown in more detail in co-issued U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. Belly plate 30 is removably secured on the lower ends of tubes or rods 36 and 38 by clamping receptacles 72 and 74. Clamping mechanisms 72 and 74 consist of a semi-circular receptacle that tubes 36 and 38 fit through. Tightening hardware 78 and 79 clamps the tube or rod to secure them within the receptacle and prevent movement. The receptacles 72 and 74 are secured on belly plate 30. The receptacles are shown mounted to the belly plate 30, and the tubes can be re-positioned within the receptacle, but the receptacles can be mounted to slots that allow the locations of the receptacles to be moved. The upper, out-turned ends 45 and 46 of supporting rods or tubes are supported in clamping receptacles 92 and 94 on shoulder straps 50 and 55. Clamps 92 and 94 hold rods or tubes 45 and 46 on the shoulder supports. Clamping mechanisms 92 and 94 consist of a semi-circular receptacle that tubes 45 and 46 fit through. Tightening hardware 98 and 99 clamps the tube or rod to secure them within the receptacle and prevent movement.

FIG. 1 shows the compound hinge 300 locked in a forward position on the tubular construction carrier. The components of the compound hinge are shown and described in more detail in FIG. 3 to 10.

The materials of construction used in this carrier 10 are very important for achieving the desired result. The belly plate 30, supporting rods or tubes 32, 34, 42, and 44, shoulder straps 50 and 55 and back bar 70 are rigid and made of a light metal such as aluminum, magnesium or titanium. The metal shoulder straps have the advantage that different sizes are readily accommodated.

Operation

The operation of this carrier should be apparent but will be described briefly for clarity. The carrier 10 is worn by a musician with the shoulder straps 50 and 55 positioned over the shoulders. The position of the shoulder straps and the upper portion of the carrier can be adjusted by loosening bolts 98 and 99. When the bolts are loosened, clamps 92 and 94 open to allow tubes 45 and 46 to slide within the clamps. When the clamps are loose, the position of the clamps on the shoulder straps can also be adjusted. The adjustment of the shoulder straps allows users of different sizes to use the carrier. The width between the shoulder straps can also be adjusted by rotating the tubes 42 and 44 within hinge 300. When tubes 42 and 44 are rotated the width of the shoulder straps are moved in and out. The rotational adjustment 41 allows the tubes to be toed-in so the width and or the position of the tubes can be adjusted. The toe-in adjustment is mostly used with tubular construction, but a similar adjustment could be made with other types of carrier construction. The belly plate 30 is attached to rods 36 and 38 that are inserted in position and secured in place by tightening bolts 78 and 79. The short outer ends of the rods are inserted into the receptacles 72 and 74 on the belly plate. When bolts 78 and 79 are loosened, tubes 36 and 38 can be moved to allow positioning of the belly plate on the carrier. This adjustment allows the carrier to accommodate user of various sizes. The belly plate has an additional attachment mechanism 110 for the percussion instrument being carried 120, e.g., drums (single or array), cymbals, xylophone, marimba, or the like. The attachment mechanism 110 allows height adjustment of the instrument. The height adjustment in this embodiment is independent from the adjustment for the belly plate 30.

The carrier is adjustable to the comfort of the wearer and also to fit different sized instruments. Clamp-receptacles 92 and 94 permit pivotal, lateral and angular adjustment of shoulder straps 50 and 55 on the out-turned ends or rod or tubes 45 and 46. Clamp-receptacles 74 and 72 permit vertical sliding adjustment of rods or tubes 36 and 38. Clamping bolt 78 holds tubes or rods 36 and or 38 onto the belly plate.

Figure 2:
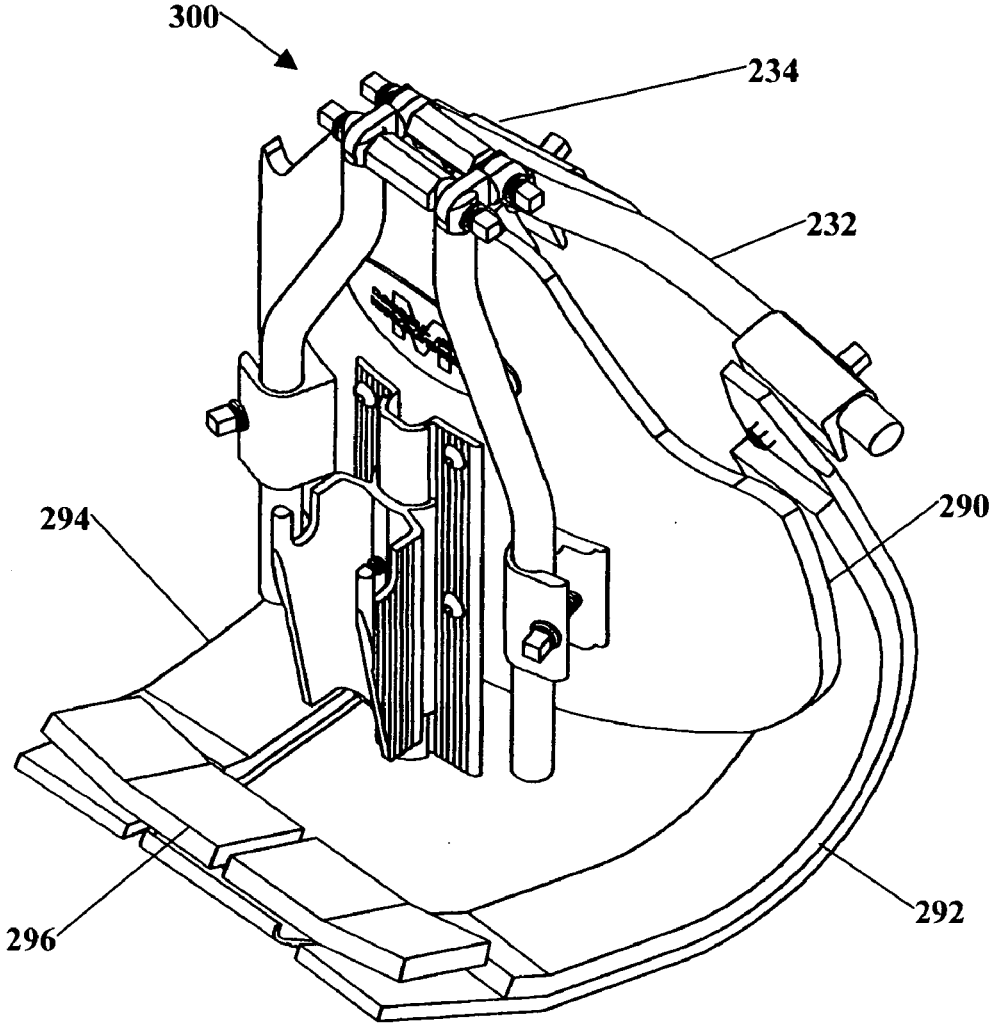
FIG. 2 is an isometric view a vest with compound hinge mechanism shown in a folded orientation.

FIG. 2 shows a complete carrier using the compound hinge. In this figure, the shoulder straps 292 and 294 are shown attached to the upper end of tubes 232 and 234. The tubes are shown clamed to the shoulder supports. The shoulder supports are connected to a back member 296. The back member may be adjustable for width to allow the carrier to fit a variety of users. The back member may also be removable. The belly plate 290 is shown folded near the shoulder straps. This folded configuration allows a smaller storage size and makes the carrier easier to transport.

Figure 3:
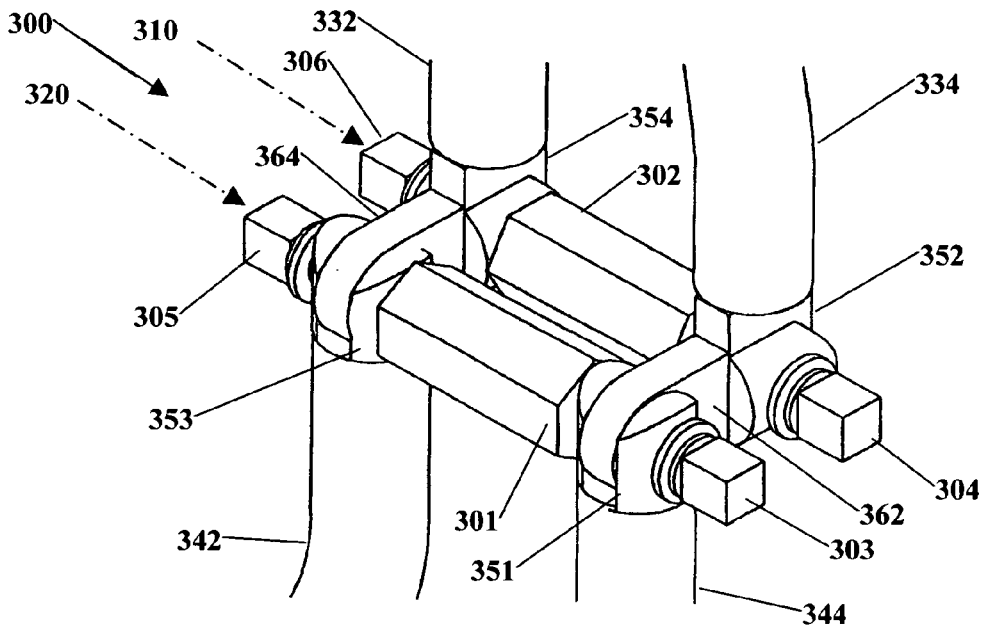
FIG. 3 is an isometric view of a compound adjustable hinge mechanism.
Figure 4:
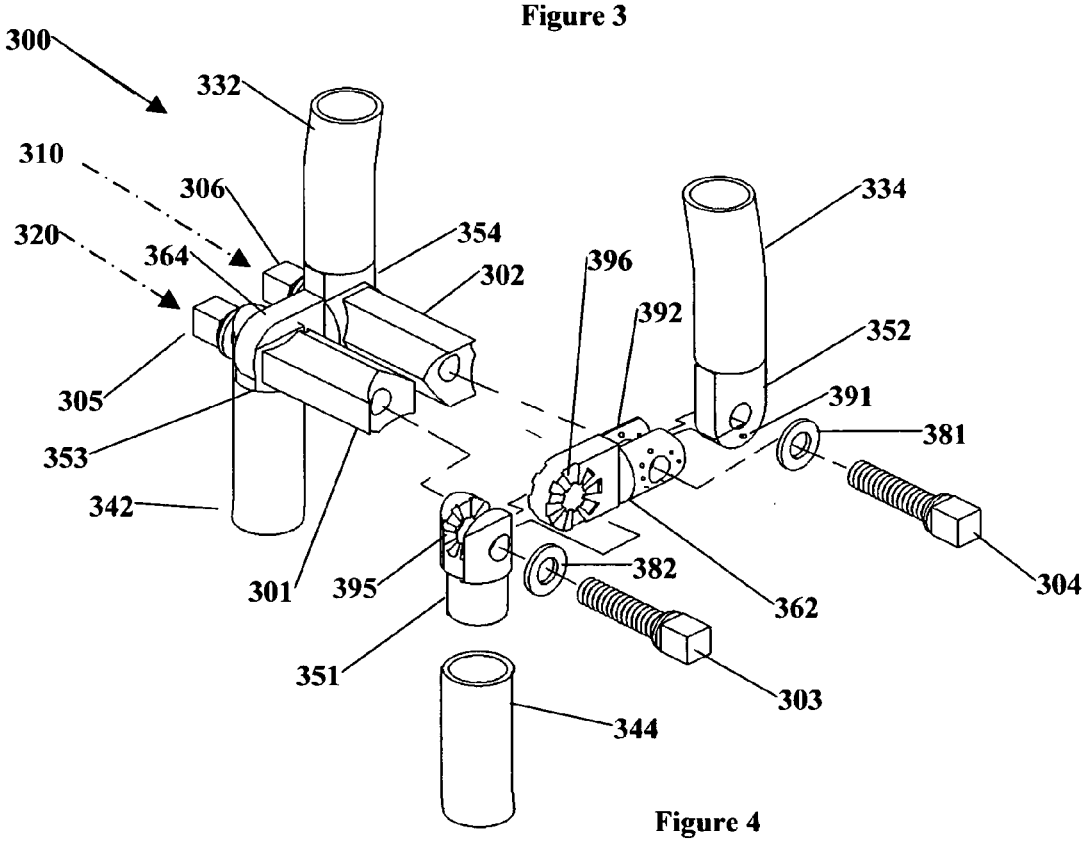
FIG. 4 is a detailed isometric exploded view of the components from FIG. 3.

Referring to FIGS. 3 to 14, there is shown a compound hinge 300. The compound hinges allow pivoting on two axes 310 and 320. FIG. 3 is a detailed view of the compound hinge mechanism. FIG. 4 is a detailed view of the compound hinge shaft from FIG. 3 where some of the parts are shown in exploded view to provide additional details regarding the construction of the compound hinge. The two axes are connected to a tubular construction carrier. Where tubes 332 and 334 are part of the upper portion of the carrier and 342 and 344 are connected to the lower portion of the carrier. Axis 310 and 320 can move rotate freely from each other. The components in each axis consist of central hex shaft 301 and 302 that bolts 303, 304, 305, and 306 thread into. A hex shaft is used so the shaft is easier to hold while the adjustment bolts are tightened or loosened. The tubes 332, 334, 342 and 344 have pivoting members 351 to 554 connected to the ends of the tubes. The pivoting mechanism also includes links 362 and 364. The bolts 303 to 306 go through connectors 351 to 354, then through links 362 and 364, and thread into central hex shafts 301 and 302. The bolts can be independently tightened or loosened to adjust that amount of movement in each hinge. Refer now to FIG. 4, that show details regarding the interface between members 362, 352 and members 362, 351. From FIG. 4, washers 381 and 382 are shown connected between bolts 304, 303 and members 351, 362. These washers are shown here as flat washers, but the washers may be any variety of washers including but not limited to wave washers, compression washers, and fiber washers or may be optionally excluded. The purpose of the washers is to provide a bearing surface for the bolts to rotate upon as they are being tightened. The interface surface between member 362 and members 351 and 352 can be a variety of types.

In the preferred embodiment, the interface between the mating bearing surfaces of member 362, 364 and members 351, 352, 353, 354 is smooth. In the case of smooth mating surfaces, one or all of bolts 303 to 306 can be loosened to allow the components of the compound hinge to move, rotate freely or provide infinite locking positions. While only two sets of compound hinge components are shown and described, more than two hinges can be utilized in the construction of the carrier. It is also contemplated that an entire carrier could be constructed with hinge components where each hinge can be individually adjusted. If the interface between the member 362 and members 351 and 352 are smooth an infinite number of angular settings can be made and locked with bolts 303 and 304 to fix the angular relationship between the compound hinge components. Using smooth interfacing surfaces, bolts 303 to 306 can be partially tightened to allow various degrees of frictional movement between the compound hinge components, or locked into position or a combination thereof.

An alternate embodiment of the mating surfaces of the compound hinge is shown with a ball 391 and hole 392 configurations. In this embodiment, one or more balls or raised areas exist of one member. The ball or raised member is shown here as 391 on item 352, the hole or recess is shown here as 392 on item 362. In this embodiment, the members can be locked in 45-degree increments, or in the positions where the ball or raised area falls into the hole or depressed area. In another embodiment of the mating surfaces of the compound hinge is shown as radial lands and groves as identified as items 395 and 396. In this embodiment four, eight or more radial lands and groves exist on the mating members 352 and 362. In this embodiment, the members can be locked in 45-degree increments, but can be manufactured with any number of increments, or positions where a land in one component falls into a groove in the mating component. In the previous described embodiment the angle between the members is adjusted by loosening bolts 303 to 306 rotating the members into position and tightening bolts 303 to 306. Three different types of mating surfaces have been described, but other types can be utilized that allow the hinge components to move and or lock in various positions.

Figure 5:
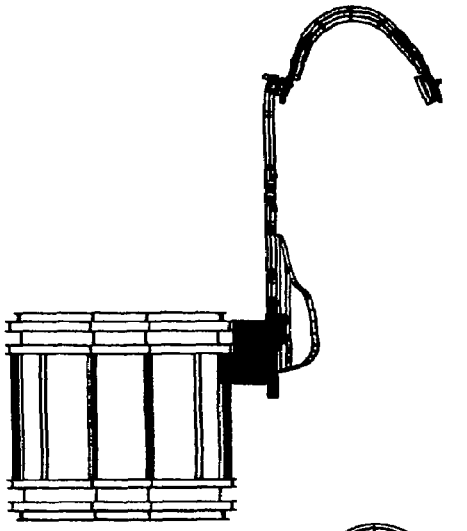
FIG. 5 is a side view of a compound adjustable hinge mechanism in the vertical orientation.
Figure 6:
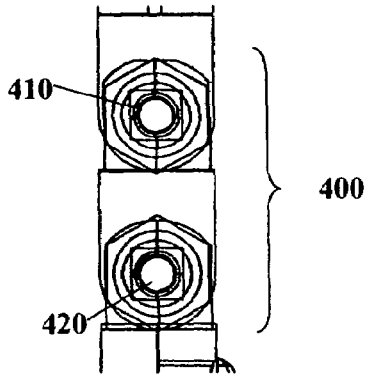
FIG. 6 is a detailed side view of the hinge mechanism from claim 5.
Figure 7:
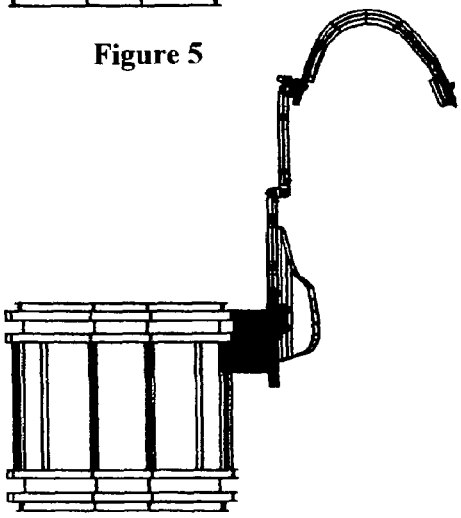
FIG. 7 is a side view of a compound adjustable hinge mechanism in the forward biased orientation.
Figure 8:
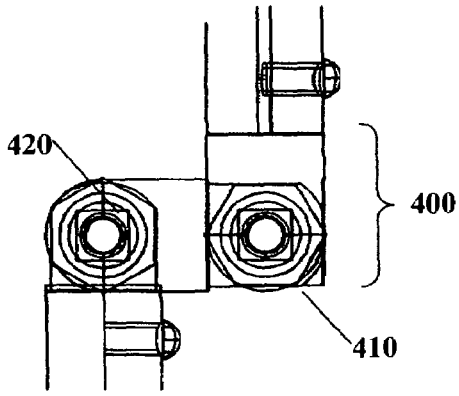
FIG. 8 is a detailed side view of the hinge mechanism from claim 7.
Figure 9:
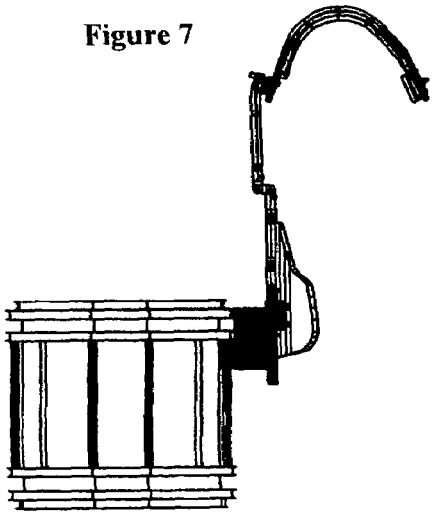
FIG. 9 is a side view of a compound adjustable hinge mechanism in the rearward biased orientation.
Figure 10:
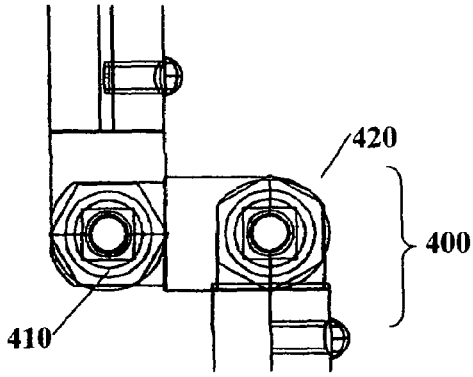
FIG. 10 is a detailed side view of the hinge mechanism from claim 9.

FIGS. 5 to 10 show the articulating or compound hinge in a variety of locked configurations. FIG. 6 shows the compound hinge in a vertical orientation where axis 410 and 420 are in vertical alignment with each other. FIG. 5 shows how this arrangement would appear when used to support a shoulder mounted carrier with a drum. FIG. 8 shows the compound hinge in a forward biased orientation where axis 420 is forward of axis 410 when viewed from a person wearing the drum mounted carrier shown in FIG. 7. FIG. 7 shows how this arrangement would appear when used to support a shoulder mounted carrier with a drum. This configuration would be useful if the carrier needs forward adjustment due to the physical characteristics of the person wearing the carrier. FIG. 10 shows the compound hinge in a back biased orientation where axis 420 is behind axis 410 when viewed from a person wearing the drum-mounted carrier shown in FIG. 9. FIG. 9 shows how this arrangement would appear when used to support a shoulder mounted carrier with a drum. This configuration would be useful if the carrier needs rearward adjustment due to the physical characteristics of the person wearing the carrier.

Figure 11:
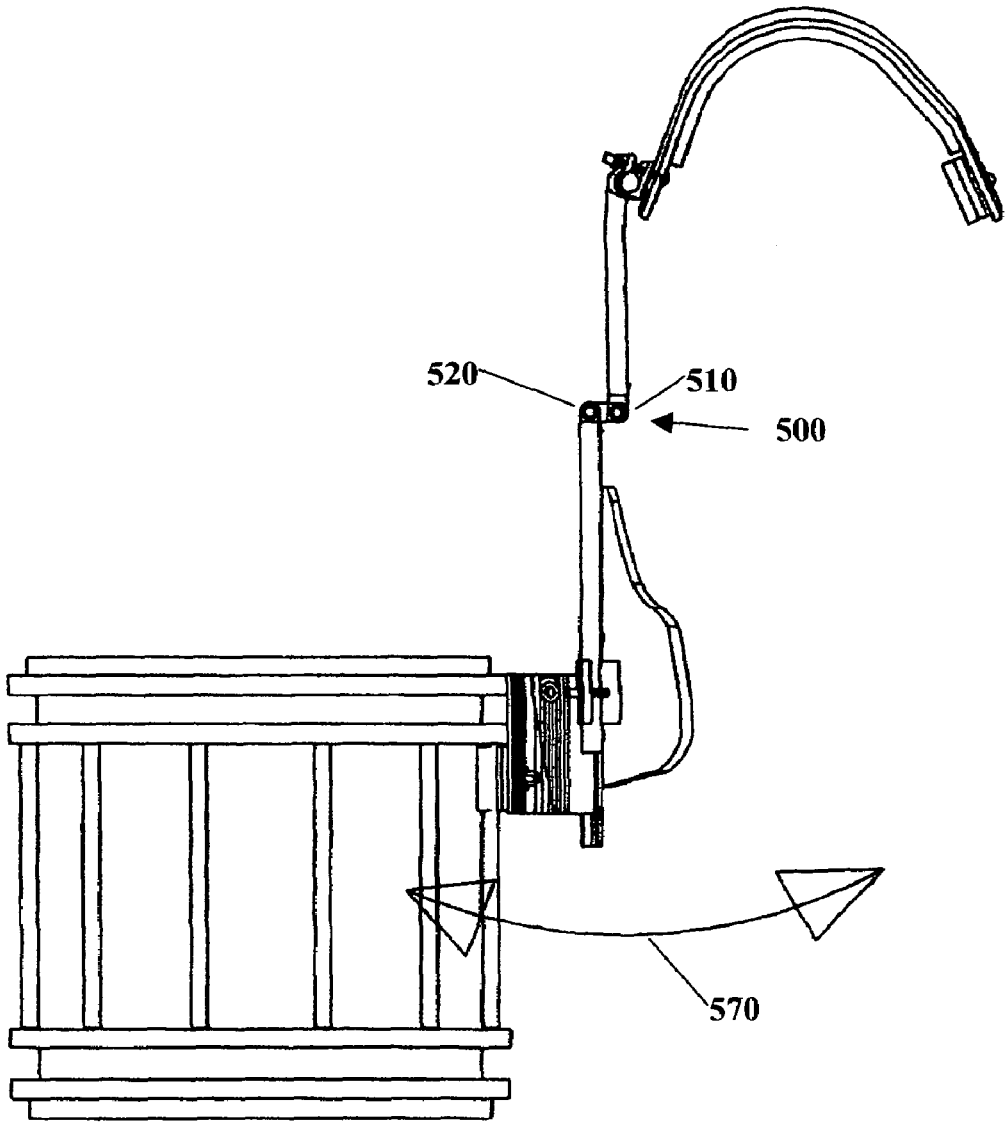
FIG. 11 is a side view of an articulating hinge mechanism showing pivotal degree of movement.

FIGS. 5 to 10 have shown various orientation of the compound hinge. An infinite number of orientations are possible where the hinges can be located in positions other than orthogonal orientations. It is also contemplated that only one axis be fixed and the second axis can freely rotate. FIG. 11 show an orientation where one axis is locked and the second axis can rotate. This figure shows motion 570 where the drum can swing with only one axis fixed. A frictional member such as a bearing, felt, washer, wave washer or other spacer material may be used between the joined hinge members to provide some resistance to rotation or pivoting.

Figure 12:
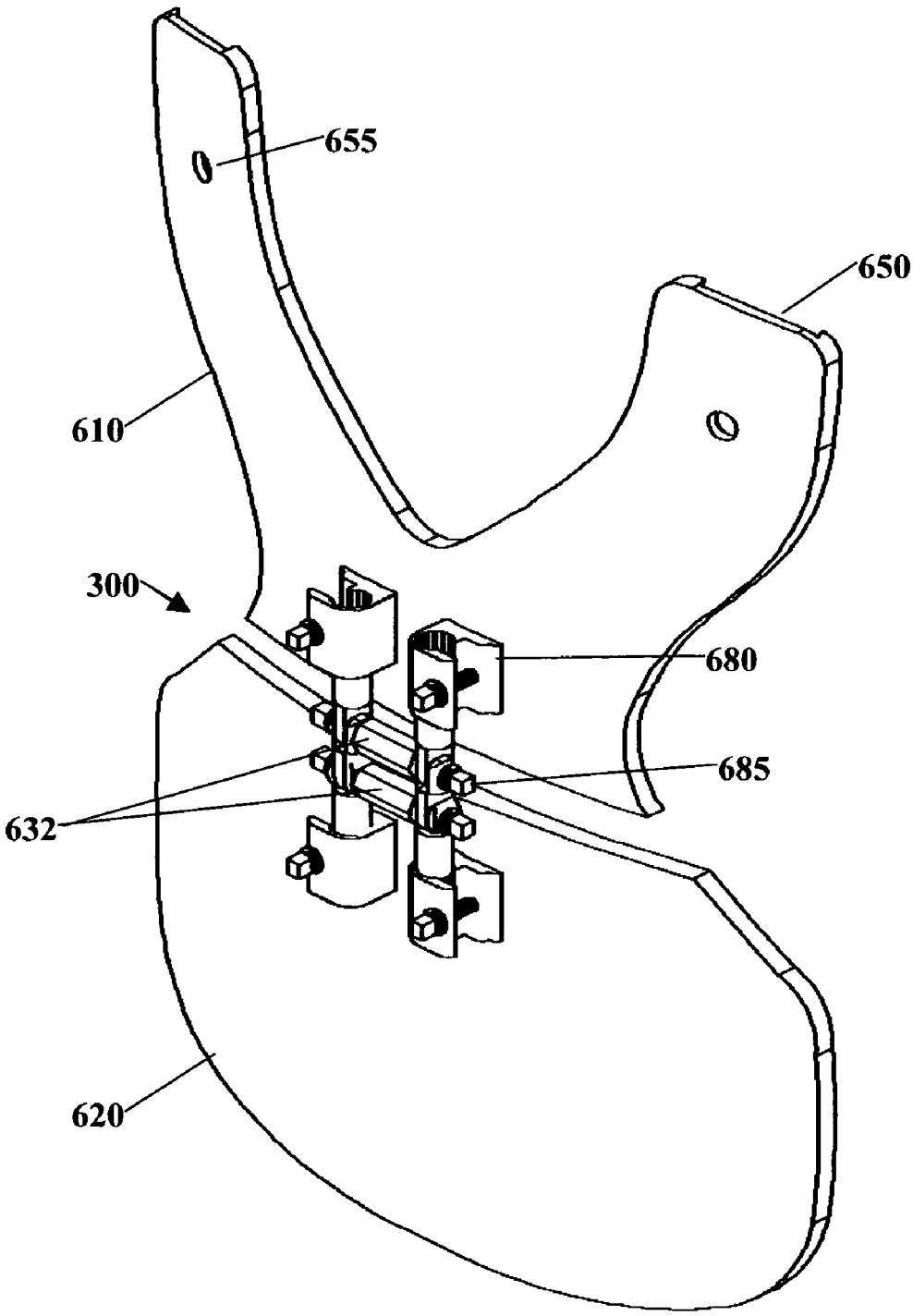
FIG. 12 is an isometric view of another embodiment of a compound hinge mechanism.
Figure 13:
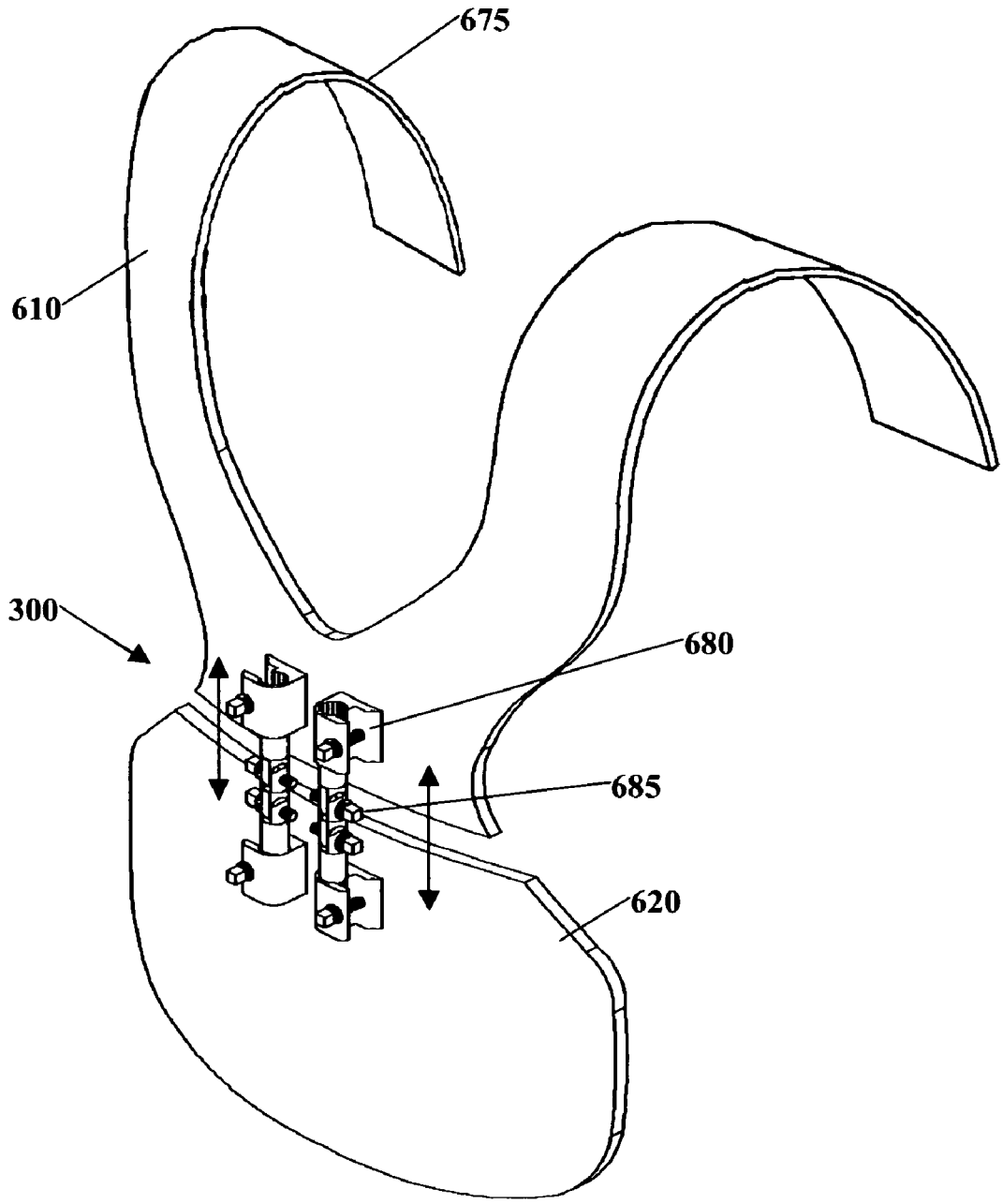
FIG. 13 is an isometric view of another embodiment of a compound hinge mechanism where the shoulder supports are integrated into the carrier.
Figure 14:
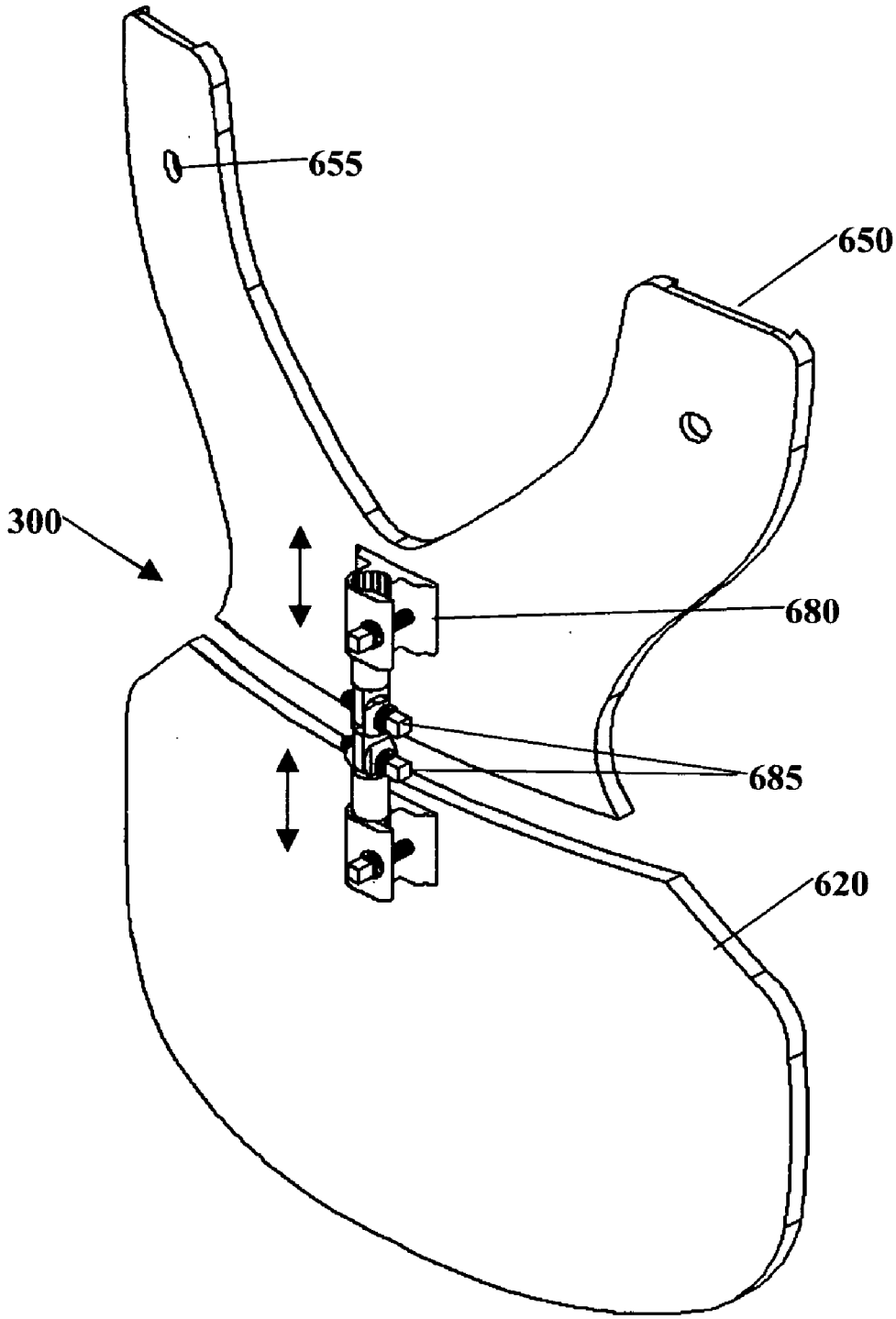
FIG. 14 is an isometric view of another embodiment of a compound hinge mechanism.

Referring to FIGS. 12 to 14, there is shown three variations on articulating vest type carriers with a variety of compound hinge designs that are contemplated. These figures show variation of compound hinge configurations that perform similar pivoting functions. In these figures, the belly plate 620, or lower component, is shown with hinge connection 685 to the upper component shown in FIGS. 12 and 13 as a chest plate 610, and in FIG. 13 as a combination chest plate and shoulder support. A variety of shoulder strap and linkage configurations can be added to the chest plate. The shoulder straps can be added to the recessed areas 650, and connected using a fastener using holes 655. While this and other figures show a recess for the shoulder connection, the connection of the shoulder straps can be flat with the vest or raised from the vest. In FIG. 12, the compound hinge mechanism includes horizontal hex members 632 that are not present in FIG. 13. The horizontal members 632 help maintain the chest plate and belly plate in a parallel orientation. The clamping member(s) 680 can be loosened to allow vertical separation adjustment between the chest and belly plates. The tension bolts 685 can be adjusted to allow free, frictional or locked movement to each hinge independently. FIG. 13 also shows integrated shoulder members 675 that are part of the upper chest component 610.

FIG. 14 shows a similar embodiment for a single vertical articulating hinge. This configuration allows vertical separation adjustment between the chest and belly plates using clamping members 680. One of the clamping members 680 may also be adjusted to allow for twist between the chest plate and the belly plate. The tension bolts 685 can be adjusted to allow free, frictional or locked movement to each hinge independently.

Various configurations of the carriers have been disclosed that show a number of different methods for construction of an instrument carrier with a clamp located in the carrier. The configuration of the carrier has been shown as tubular and vest construction, but any type of carrier construction may be utilized provided a front articulating hinge mechanism is incorporated that allows the upper and lower portions to pivot for movement or folding. The construction of the carrier has been shown with adjustable and or movable shoulder straps, but the shoulder straps can be integrate into the upper portion of the carrier as manufactured, welded, bonded, or permanently attached. Other configurations of the compound hinge may include more than two hinged links. In an extreme configuration, the carrier can be made entirely of hinged links so each section can be individually adjusted and set.

Thus, specific embodiments and applications for single, compound, and elastomeric hinge configurations for percussion instrument carrier have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A hinged carrier for a shoulder supported harness assembly for supporting percussion instruments, comprising:

a shoulder supported carrier structure for supporting percussion instruments having at least two shoulder supporting members for securing said structure on the shoulders of a user, and an upper and lower carrier components wherein the upper and lower components are interconnected with at least one lockable multi-hinged mechanism to fix the angular relationship of the upper and lower carrier components.

2. The multi-hinged component from claim 1 wherein each hinge can be independently adjusted for positive, forward, vertical, backward and negative horizontal position.

3. The multi-hinged component from claim 1 wherein each hinge can be independently adjusted for rotational friction.

4. The hinged carrier from claim 1 wherein the multi-hinged mechanism allows the upper and lower components to fold adjacent to each other.

5. The hinged carrier from claim 1 wherein at least one hinge has fixed orientation lands, grooves, holes, raised or depressed areas.

6. The shoulder supported harness from claim 1 further includes a back support member.

7. The shoulder supported harness assembly for supporting percussion instruments according to claim 1, wherein said shoulder support members are rigid shoulder straps and are removably and rigidly secured to the carrier.

8. The shoulder supported harness assembly for supporting percussion instruments according to claim 1, wherein the assembly is formed from magnesium, aluminum, titanium, fiberglass, a cast molded or formed rigid plastic.

9. The body components from claim 1 wherein the body components are tubular, T-bar or vest construction.

10. The upper carrier component from claim 1 wherein the upper component rests against the users chest.

11. The lower carrier component from claim 1 wherein the lower component rests against the users belly and or hips.

12. The upper and lower carrier components from claim 1 wherein the distance between the upper and lower components are adjustable.

13. A hinged carrier for a shoulder supported harness assembly for supporting percussion instruments, comprising:

a shoulder supported carrier structure for supporting percussion instruments having at least two shoulder supporting members for securing said structure on the shoulders of a user, and an upper and lower carrier components wherein the upper and lower components are attached with a at least one frictional hinge linkage, where the hinge that allows the upper and lower carrier components to be locked in an angular relationship.

14. The shoulder supported harness from claim 13 further includes a back member.

15. The shoulder supported harness assembly for supporting percussion instruments according to claim 13 wherein said shoulder support members are rigid shoulder straps and are removable and rigidly secured to the carrier.

16. The shoulder supported harness assembly for supporting percussion instruments according to claim 13 wherein the assembly is formed from magnesium, aluminum, titanium, fiberglass, a cast molded or formed rigid plastic.

17. The body components from claim 13 wherein the body components are tubular, T-bar or vest construction.

18. The at least one hinged linkage from claim 13 wherein the connection of the hinge to the upper and lower components allows the distance between the upper and lower components to be adjusted.

19. The at least one hinges linkage from claim 13 wherein each hinge can be adjusted for rotational friction.

20. The upper carrier component from claim 13 wherein the upper component rests against the users chest.

21. The lower carrier component from claim 13 wherein the lower component rests against the users belly.

22. The hinged carrier from claim 13 wherein the multi-hinged mechanism allows the upper and lower components to fold adjacent to each other.

23. The hinged carrier from claim 13 wherein the at least one hinge hinged linkage has fixed orientation detents.

24. The rotational positing from claim 13 where the positioning adjusts the width or toe-in of the shoulder straps.

* * * * *